US008137245B2

(12) United States Patent
Tittle

(10) Patent No.: US 8,137,245 B2
(45) Date of Patent: Mar. 20, 2012

(54) NON-ELECTRICAL EXERCISE APPARATUS

(76) Inventor: Patrick J. Tittle, St. Paul, MN (US)

( * ) Notice: Subject to any disclaimer, the term of this patent is extended or adjusted under 35 U.S.C. 154(b) by 0 days.

(21) Appl. No.: 12/924,511

(22) Filed: Sep. 29, 2010

(65) Prior Publication Data

US 2011/0077132 A1 Mar. 31, 2011

Related U.S. Application Data

(60) Provisional application No. 61/277,812, filed on Sep. 30, 2009.

(51) Int. Cl.
*A63B 22/00* (2006.01)
*A63B 22/16* (2006.01)

(52) U.S. Cl. ..... 482/51; 482/146; 482/147

(58) Field of Classification Search ..... 482/51, 482/52, 70, 71, 79, 80, 114–120, 133–138, 482/142, 145–147
See application file for complete search history.

(56) References Cited

U.S. PATENT DOCUMENTS 3,612,519 A * 10/1971 Larson ..... 482/147
4,886,050 A * 12/1989 Iams et al. ..... 601/23
5,391,130 A * 2/1995 Green et al. ..... 482/71
5,632,711 A * 5/1997 Hwang ..... 482/147
6,234,935 B1 * 5/2001 Chu ..... 482/51
6,875,159 B2 * 4/2005 Chuang ..... 482/51
7,104,928 B1 * 9/2006 Liu et al. ..... 482/52
7,179,236 B2 * 2/2007 Galvez Campos ..... 601/29
7,338,414 B1 * 3/2008 Hsiung ..... 482/71
7,621,861 B1 * 11/2009 Kalember et al. ..... 482/147
7,727,121 B1 * 6/2010 Wang ..... 482/52
7,775,953 B2 * 8/2010 Wang ..... 482/147
7,862,491 B1 * 1/2011 Wang ..... 482/147
7,901,329 B2 * 3/2011 Tsai ..... 482/51
7,927,267 B2 * 4/2011 Splane ..... 482/142
2007/0287602 A1 * 12/2007 Hsiung ..... 482/71
2011/0071006 A1 * 3/2011 Lai ..... 482/53

* cited by examiner

*Primary Examiner* — Loan Thanh
*Assistant Examiner* — Daniel Roland
(74) *Attorney, Agent, or Firm* — Jacobson and Johnson; Thomas N. Phung

(57) ABSTRACT

A non-electric low impact exercise apparatus comprising a base, a first footpad having a first end and a second end and a second footpad having a first end and a second end, and at least one cross member pivotally attached to the base with the cross member swivelable with respect to the base and pivotally connecting the first footpad to the second footpad with the first footpad and the second footpad swingable in a clockwise and arcing and a counterclockwise and arcing direction along a single plane with respect to the base by virtue of the pivotal attachment to the cross member.

12 Claims, 4 Drawing Sheets

NON-ELECTRICAL EXERCISE APPARATUS

CROSS REFERENCE TO RELATED APPLICATIONS

This application claims priority to currently pending U.S. Provisional Application Ser. No. 61/277,812; filed on Sep. 30, 2009; titled NON-ELECTRICAL EXERCISE APPARATUS.

FIELD OF THE INVENTION

This invention relates to exercise and blood circulation devices and, more specifically, to a small, portable, lightweight non-electric exercise and blood circulation apparatus that may be used in small and confined spaces such as in the confines of an airplane seating area and underneath an office desk to provide for low impact exercise to increase blood circulation and improve physical fitness.

STATEMENT REGARDING FEDERALLY SPONSORED RESEARCH OR DEVELOPMENT

None

REFERENCE TO A MICROFICHE APPENDIX

None

BACKGROUND OF THE INVENTION

In today's society, people tend to work longer hours, which may prevent them from having adequate time to be active thereby leading to unhealthiness and weigh gain issues. This is especially true for individuals who have desk jobs during which the person may sit at a specific locations for hours upon hours. Sitting at a specific location for extended time periods may also lead to poor blood circulation and cramping. People who frequently fly for business or leisure may also sit in the confines of an airplane for extended time periods, which may also lead to cramping due to poor blood circulation. It is commonly known that doing relatively low impact exercise over a longer period of time promotes better blood circulation and not only alleviates cramping but is more efficient for weight loss than a vigorous exercise over a shorter period of time.

Exercise devices that are currently available generally are heavy and difficult to transport, are expensive and also complex in their structure, have electrical-based parts, which requires the use of electricity, and requires the user to be fully active. The aforementioned exercise devices are also not particularly ideal for use while at work or while sitting in an airplane due to office rules and airline regulations.

There thus is a need for a non-electrical low impact exercise apparatus that may be used in a variety of environment, including but not limited to while sitting in an airplane, sitting at a desk, sitting in trains or sitting at home and provides for improved blood circulation.

BRIEF SUMMARY OF THE INVENTION

Briefly, the present invention comprises a non-electrical low impact exercise apparatus that is suitable for use in a variety of environment wherein its use provides for increase blood circulation to alleviate various problems that may occur during extended sittings and/or improve overall physical fitness. The aforementioned exercise apparatus comprises a base, a first footpad and a second footpad and at least one cross member pivotally attached to the base. The at least one cross member is swivelable with respect to the base and pivotally connects the first footpad to the second footpad with the first footpad and the second footpad swingable in a clockwise and arcing and a counterclockwise and arcing direction along a single plane with respect to the base by virtue of the pivotal attachment to the at least one cross member.

The present invention also comprises a non-collapsible and non-electric low impact exercise apparatus having a base, a first rigid cross member and a second rigid cross member pivotally attached to the base in a spaced condition from each other. The exercise apparatus also includes a first footpad and a second footpad pivotally connected to the first rigid cross member and the second rigid cross member with the pivotally connection of the first and second rigid cross members to the base and the pivotally connection of the first and second footpads to the first and second rigid cross members allowing the first and second footpads to swing in a clockwise and arcing and a counterclockwise and arcing direction along a single plane with respect to the base while limiting the range of movement of the first and second footpads through direct contact between the first footpad and the second footpad.

DESCRIPTION OF THE PREFERRED EMBODIMENT

Figure 1:
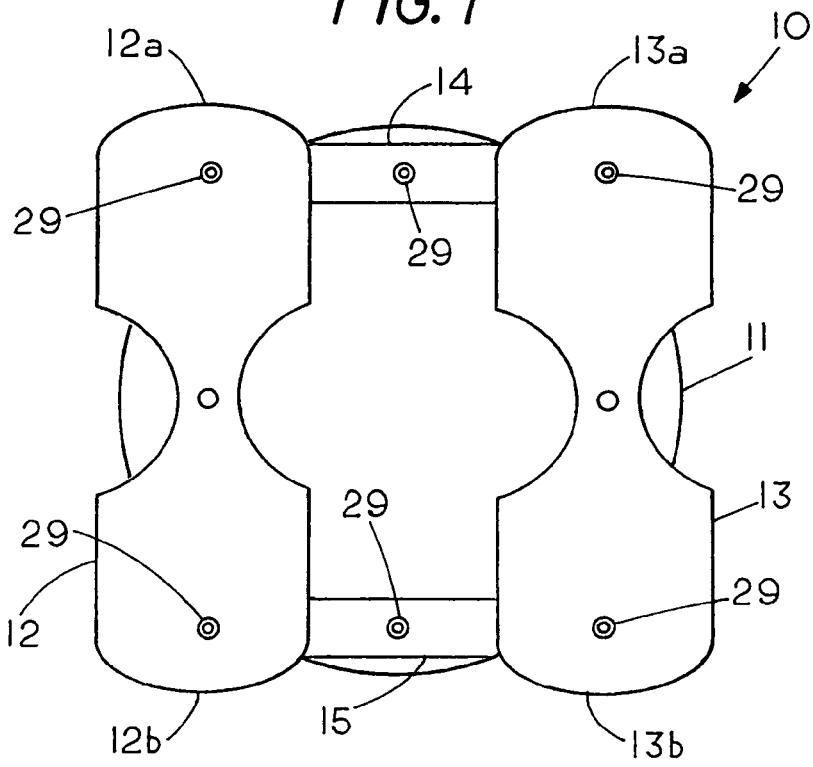
FIG. 1 shows a top view of a non-electric low impact exercise apparatus according to a preferred embodiment of the present invention.

Referring now specifically to the drawings, in which identical or similar parts are designated by the same reference numerals throughout, a detailed description of the present invention is given. It should be understood that the following detailed description relates to the best presently known embodiment of the invention. However, the present invention can assume numerous other embodiments, as will become apparent to those skilled in the art.

Figure 2:
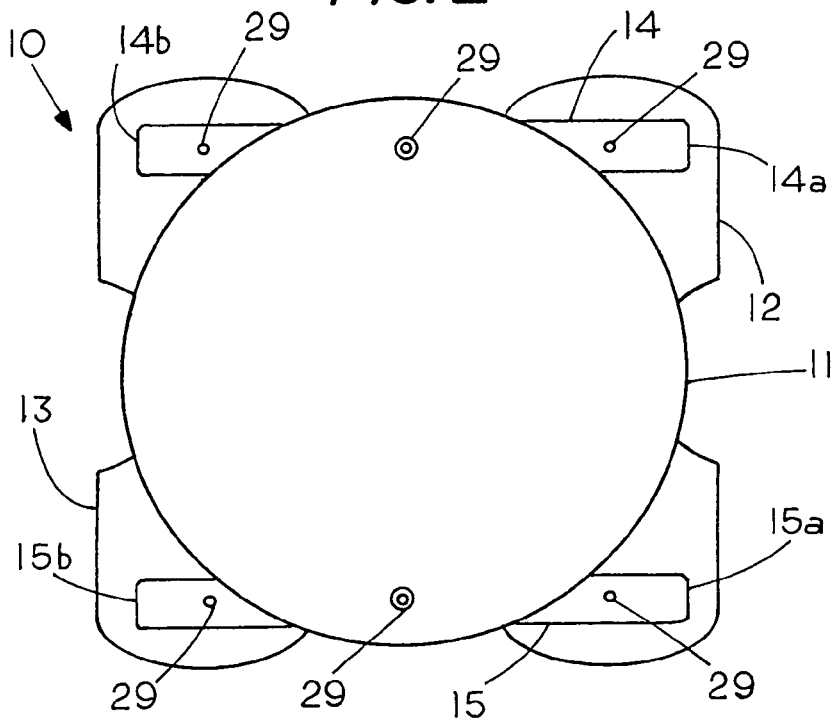
FIG. 2 shows a bottom or underside view of the non-electric low impact exercise apparatus of FIG. 1.

Now referring to FIGS. 1 and 2, FIG. 1 shows a top view and FIG. 2 shows a bottom or underside view of an embodiment of a portable, lightweight, non-electric exercise and blood circulation apparatus 10. By portable and lightweight, it is meant that non-electric low impact exercise apparatus 10 may be suitable for used in a variety of environments including but not limited to while sitting in the confines of an airplane, sitting at a desk, sitting in trains or sitting at home.

The non-electric low impact exercise apparatus 10 generally comprises a base 11, a first footpad 12 having a first end 12*a* and a second end 12*b*, a second footpad 13 having a first end 13*a* and a second end 13*b*, and a first cross member 14 having a first end 14*a* and a second end 14*b* and a second cross member 15 having a first end 15*a* and a second end 15*b*. Although base 11 is shown in the embodiment of FIG. 1 as comprising a circular shape, alternative embodiment of the present invention may include a non-electric low impact exercise apparatus having bases with alternative shapes including but not limited to a square-shaped, a rectangular-shaped, and a triangular-shaped base. A feature of the present invention is that the non-electric low impact exercise apparatus preferably is form from a non-metallic lightweight material including but not limited to wood, a polymer plastic, and a rubber-based material, thereby resulting in the non-electric low impact exercise apparatus being suitable for conveniently bringing through metal detectors and onto airplanes for use especially on long flights. However, there may be versions of the non-electric low impact exercise apparatus that may be formed from a metallic material if it is intended to be used at home or in a gym setting to provide for increase durability. In addition, the non-electric low impact exercise apparatus preferably comes pre-assembled and has a portable, compact, and low profiled design so as to prevent the need for disassembly or collapsing for storage and transportation.

In the assembled form of the non-electric low impact exercise apparatus 10, the first cross member 14 and the second cross member 15 are each pivotally attached to the base 11 in a spaced condition from each other with the first cross member 14 and the second cross member 15 swivelable with respect to the base 11. The first cross member 14 and the second cross member 15 also pivotally connect the first footpad 12 to the second footpad 13. More specifically, as shown in the embodiment of FIGS. 1 and 2, the first end 14*a* of the first cross member 14 is pivotally connected proximal to the first end 12*a* of first footpad 12, the second end 14*b* of the first cross member 14 is pivotally connected proximal to the first end 13*a* of second footpad 13, the first end 15*a* of the second cross member 15 is pivotally connected proximal to the second end 12*b* of first footpad 12, and the second end 15*b* of the second cross member 15 is pivotally connected proximal to the second end 13*b* of second footpad 13. A feature of the present invention is that the first footpad 12 and the second footpad 13, by virtue of their pivotal connection to cross members 14 and 15, function to swing in a direction arc with respect to the base 11. Swinging at a direction arc with respect to the base 11 permits the non-electric low impact exercise apparatus 10 to be used in small confined spaces such as underneath an office desk or underneath an airplane's passenger seat.

Although the base, footpads and cross member(s) of the non-electric low impact exercise apparatus of the present invention may be pivotally connected to each other by a plurality of devices, the embodiment of FIGS. 1 and 2 show base 11, footpads 12 and 13 and cross members 14 and 15 of non-electric low impact exercise apparatus 10 pivotally connected to each other by a plurality of pivot pins 29. Although not shown, in alternative embodiments, the base, footpads and cross member(s) may also be pivotally connected to each other by a plurality of resistance adjustable pivot pins that permit the user to vary the resistance to the movement of the footpads and/or cross member(s). The non-electric low impact exercise apparatus of the present invention may also include other forms of resistance inducing devices including but not limited to the use of various types of springs, coils, bungee cords, weight systems, and rope systems to be applied to the apparatus.

Although the embodiment of FIGS. 1 and 2 show non-electric low impact exercise apparatus 10 having two cross members, alternative embodiments may comprise a non-electric low impact exercise apparatus having as few as one to a plurality of cross members.

Figure 5:
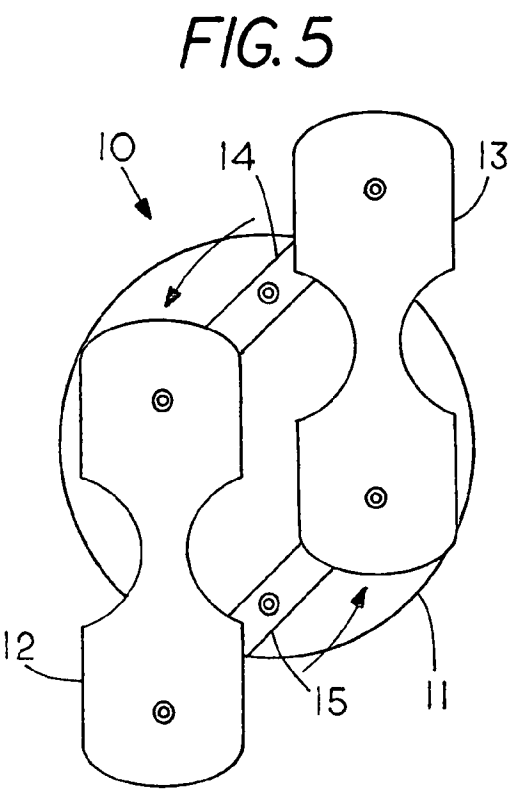
FIG. 5 is a top view showing the non-electric low impact exercise apparatus of FIGS. 1 and 2 in a right foot extended position.
Figure 4:
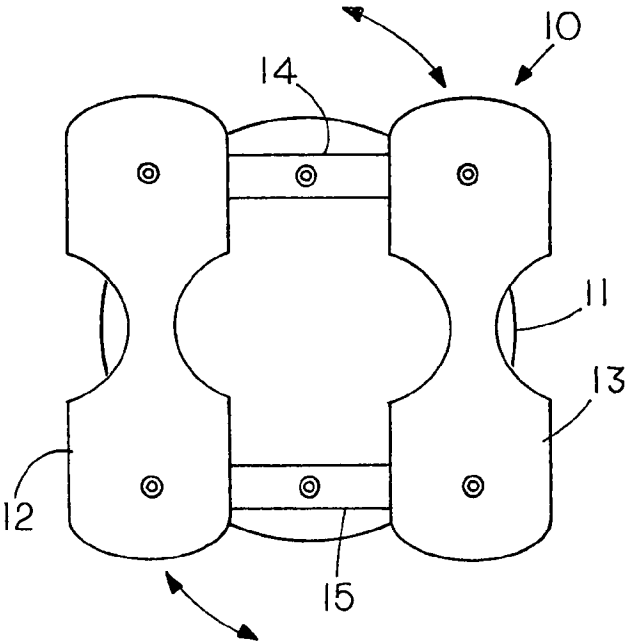
FIG. 4 is a top view showing the non-electric low impact exercise apparatus of FIGS. 1 and 2 in a normal or intermediate position.
Figure 3:
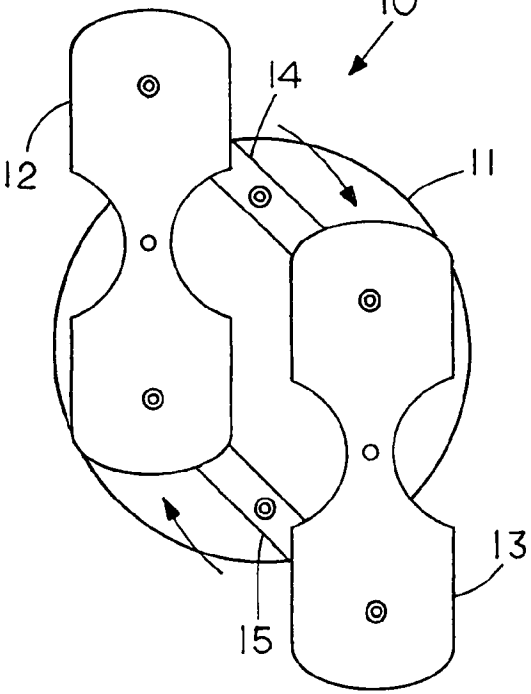
FIG. 3 is a top view showing the non-electric low impact exercise apparatus of FIGS. 1 and 2 in a left foot extended position.

Referring to FIGS. 3, 4, and 5, FIGS. 3, 4, and 5 show non-electric low impact exercise apparatus 10 in different working positions. More specifically, FIG. 4 is a top view showing non-electric low impact exercise apparatus 10 in a normal or intermediate position identified by first footpad 12 and second footpad 13 positioned parallel to each other and first cross member 14 and second cross member 15 also positioned parallel to each other.

FIG. 3 is a top view showing non-electric low impact exercise apparatus 10 in a left foot extended position identified by first footpad 12 and second footpad 13 pivoting in a clock wise and arcing direction and the ends 14*a*, 14*b*, 15*a*, and 15*b* of the cross members 14 and 15 swinging in a clock wise direction and ending with the first footpad 12 positioned in a forward condition and the second footpad 13 positioned in a rearward condition with respect to the first footpad 12.

FIG. 5 is a top view showing non-electric low impact exercise apparatus 10 in a right foot extended position identified by the first footpad 12 and the second footpad 13 pivoting in a counter clock wise and arcing direction with the ends 14*a*, 14*b*, 15*a*, and 15*b* of the cross members 14 and 15 swinging in a counter clock wise direction and ending with the second footpad 13 positioned in a forward condition and the first footpad 12 positioned in a rearward condition with respect to the second footpad 13.

It is noted that the pivotal movement of footpads 12 and 13 in the clockwise and arcing and counter clockwise and arcing direction provides for semi-circular to semi-elliptical sliding movements preferably along a single plane that bring a greater number of muscle groups into play and increases their involvement for a more effective stationary workout and promoting greater blood circulation and overall user's health and physical fitness. However, due to the nature of its design, the non-electric low impact exercise apparatus 10 does not provide for a motion that would displace the first and second footpads towards or away from the base such as for example a stepping motion or the like. In view of the aforementioned, it is preferred that the cross member or cross members are rigid and have little to no flexibly to them.

In the operation of exercise apparatus 10, a user respectively places the user's left foot on the first footpad 12 and places the user's right foot on the second footpad 13. The user then uses his or her legs to continuously and slidingly pivot the first footpad 12 and the second footpad 13 between the left foot extended position and the right foot extended position in a synchronized motion. Although alternative embodiment of non-electric low impact exercise apparatus may include stoppers supported on the base to limit movement of first footpad 12 and second footpad 13 from moving beyond the left foot extended position and the right foot extended position, in the embodiment of FIGS. 1-5, the first footpad 12 and the second footpad 13 of non-electric low impact exercise apparatus 10 are prevented from moving beyond the left foot extended position and the right foot extended position by direct contact between the first footpad 12 and the second footpad 13.

Figure 6:
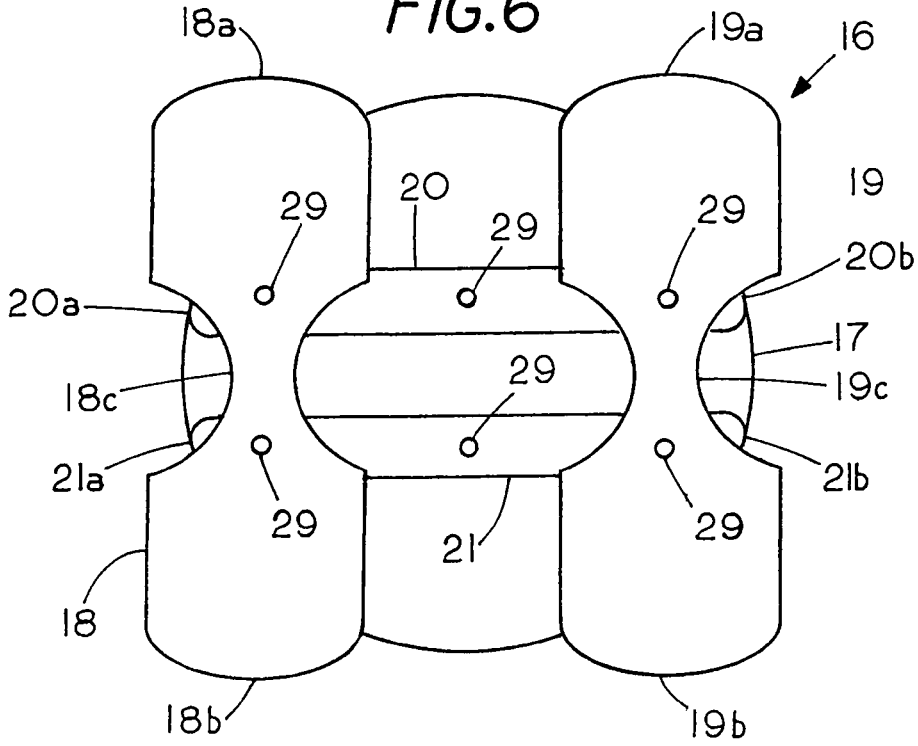
FIG. 6 shows a top view of an alternative embodiment of a non-electric low impact exercise apparatus in which the cross members are attached to the midpoint regions of the footpads.

FIG. 6 shows a top view of an alternative embodiment of a non-electric low impact exercise apparatus 16 similar to the non-electric low impact exercise apparatus 10 of FIGS. 1-5 in that non-electric low impact exercise apparatus 16 generally comprises a base 17, a first footpad 18 having a first end 18*a* and a second end 18*b*, a second footpad 19 having a first end 19*a* and a second end 19*b*, and a first cross member 20 having a first end 20*a* and a second end 20*b* and a second cross member 21 having a first end 21*a* and a second end 21*b*.

However, unlike non-electric low impact exercise apparatus 10, the first end 20*a* of the first cross member 20 of exercise apparatus 16 is pivotally connected to first footpad 18 proximal a midpoint 18*c* between the first end 18*a* and the second end 18*b* of first footpad 18. Similarly the first end 21*a* of the second cross member 21 of exercise apparatus 16 is pivotally connected to first footpad 18 proximal midpoint 18*c* of first footpad 18 and space from the first cross member 20. The second end 20*b* of the first cross member 20 is pivotally connected to second footpad 19 proximal a midpoint 19*c* between the first end 19*a* and the second end 19*b* of second footpad 19. Similarly the second end 21*b* of the second cross member 21 is pivotally connected to second footpad 19 proximal midpoint 19*c* of second footpad 19 but space from the first cross member 20. Similar to non-electric low impact exercise apparatus 10, the first footpad 18 and the second footpad 19, by virtue of their pivotal connection to cross members 20 and 21, function to swing in a direction arc with respect to the base 17. Swinging at a direction arc with respect to the base 17 permits the non-electric low impact exercise apparatus 16 to be used in small confined spaces such as underneath an office desk or underneath an airplane's chair.

Figure 7:
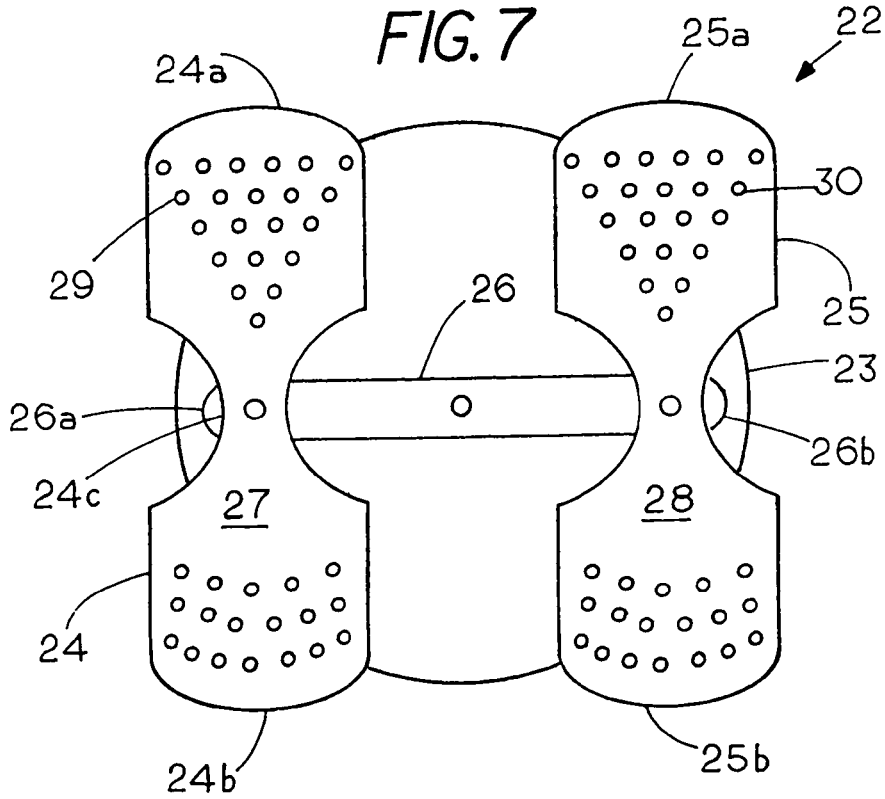
FIG. 7 shows a top view of an alternative embodiment of a non-electric low impact exercise apparatus having a single cross member.

FIG. 7 shows a top view of an alternative embodiment of a non-electric low impact exercise apparatus 22 similar to the non-electric low impact exercise apparatus 10 of FIGS. 1-5 in that non-electric low impact exercise apparatus 22 generally comprises a base 23, a first footpad 24 having a first end 24*a* and a second end 24*b*, a second footpad 25 having a first end 25*a* and a second end 25*b*. However, unlike non-electric low impact exercise apparatus 10, non-electric low impact exercise apparatus 22 includes the use of a single cross member 26 instead of a pair of cross member 14, 15 as shown in the non-electric low impact exercise apparatus 10 of FIGS. 1-5.

In the assembled form of non-electric low impact exercise apparatus 22, a first end 26*a* of the cross member 26 is pivotally connected to first footpad 24 proximal a midpoint 24*c* between the first end 24*a* and the second end 24*b* of first footpad 24. The second end 26*b* of the first cross member 26 is pivotally connected to second footpad 25 proximal a midpoint 25*c* between the first end 25*a* and the second end 25*b* of second footpad 25. The first footpads 24 and the second footpad 25, by virtue of their pivotal connection to cross member 26, function to swing in a direction arc with respect to the base 23. Swinging at a direction arc with respect to the base 23 permits the non-electric low impact exercise apparatus 22 to be used in small confined spaces such as underneath an office desk or underneath an airplane's chair. In the embodiment of FIG. 7, the first footpad 24 and the second footpad 25 are also shown as each including slip resistant treads 29 and 30 located on their foot engaging surfaces 27 and 28.

Figure 8:
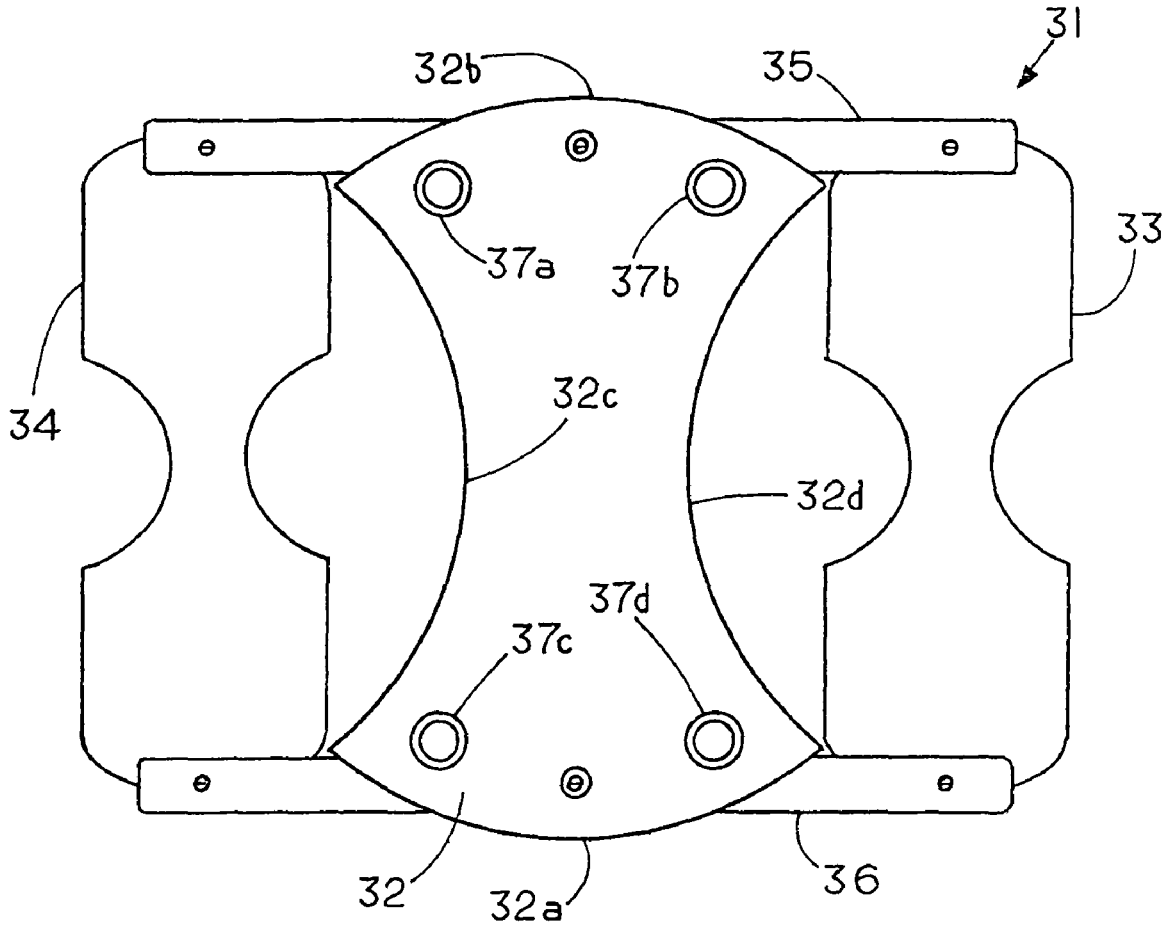
FIG. 8 shows a bottom or underside view of an alternative embodiment of the non-electric low impact exercise apparatus having a base with four sidewalls.

FIG. 8 shows a bottom or underside view of an alternative embodiment of a portable, non-electric exercise and blood circulation apparatus 31. Exercise apparatus 31 is similar to the exercise apparatus 10 of FIGS. 1, 2, 3, and 4 in that exercise apparatus 31 includes a base 32, a first footpad 33, a second footpad 34, a first cross member 35 and a second cross member 36 with the first cross member 35 and the second cross member 36 pivotally connected to base 32 in a spaced condition from each other such that the cross member 35, 36 are swivelable with respect to the base 32. The first cross member 35 and the second cross member 36 are also pivotally connected the first footpad 33 and to the second footpad 34. However, unlike the base 11 of exercise apparatus 10, which comprises a circular shaped base, the base 32 of exercise apparatus 31 comprises a flat four-sided member having a pair of corresponding concaving sidewalls 32*a*, 32*b* and a pair of corresponding convexing sidewalls 32*c*, 32*d*.

Exercise apparatus 31 is also shown having an optional set of elevating members 37*a*, 37*b*, 37*c*, and 37*d* connected to an underside of the base 32 with the set of elevating members 37*a*, 37*b*. 37*c*, and 37*d* for supporting the base 32 on support surfaces such as carpet and linoleum.

I claim:

1. A non-electric low impact exercise apparatus comprising:

a base;

a first footpad having a first end and a second end and a second footpad having a first end and a second end; and a first cross member having a first end and a second end; said first cross member pivotally attached directly to said base midway between said ends of said first cross member;

a second cross member having a first end and a second end; said second cross member pivotally attached directly to said base midway between said ends of said second cross member, said first cross member and said second cross member swivelable with respect to said base and pivotally connecting said first footpad to said second footpad, said first footpad and said second footpad swingable in a clockwise and arcing and a counterclockwise and arcing direction along a single plane with respect to said base by virtue of the pivotal attachment to said first cross member and said second cross member.

2. The exercise apparatus of claim 1 wherein said first cross member and said second cross member comprises a first rigid cross member and a second rigid cross member.

3. The exercise apparatus of claim 2 wherein said base comprises a circular shaped base.

4. The exercise apparatus of claim 2 wherein said exercise apparatus is formed from a non-metallic material.

5. The exercise apparatus of claim 2 wherein said exercise apparatus is form from a polymer plastic.

6. The exercise apparatus of claim 2 wherein said base, said footpad and said first cross member and said second cross member are pivotally connected to each other by a plurality of pivot pins.

7. The exercise apparatus of claim 2 wherein said base, said footpad and said first cross member and said second cross member are pivotally connected to each other by a plurality of resistance adjustable pivot pins.

8. A non-collapsible and non-electric low impact exercise apparatus comprising:

a one-piece base;

a first rigid cross member having a first end and a second end; said first rigid cross member pivotally attached to said base midway between said ends of said cross member;

a second rigid cross member having a first end and a second end; said second rigid cross member pivotally attached to said base midway between said ends of said cross member and spaced from said first rigid cross member;

a first footpad having a first end and a second end with said first end of said first footpad pivotally connected to said first rigid cross member proximal said first end of said first rigid cross member and said second end of said first footpad pivotally connected to said second rigid cross member proximal to said first end of said second rigid cross member; and a second footpad having a first end and a second end with said first end of said second footpad pivotally connected to said first rigid cross member proximal to said second end of said first rigid cross member and said second end of said second footpad pivotally connected to said second rigid cross member proximal said second end of said second rigid cross member, the pivotal connection of said first and second rigid cross members to said base and the pivotal connection of said first and second footpads to said first and second rigid cross members permit said first and second footpads to swing in a clockwise and arcing and a counterclockwise and arcing direction along a single plane with respect to said base while limiting the range of movement of said first and second footpads through direct contact between said first footpad and said second footpad.

9. The exercise apparatus of claim 8 wherein said base comprises a circular shaped base.

10. The exercise apparatus of claim 9 wherein said exercise apparatus is formed from a non-metallic material.

11. The exercise apparatus of claim 10 wherein said base, said footpad and said at least one cross member are pivotally connected to each other by a plurality of pivot pins.

12. The exercise apparatus of claim 11 wherein said base, said footpad and said at least one cross member are pivotally connected to each other by a plurality of resistance adjustable pivot pins.

* * * * *